United States Patent [19]

Fox

[11] Patent Number: 4,834,356

[45] Date of Patent: May 30, 1989

[54] ACCESSORY WORK HOLDING ELEMENT FOR USE WITH A VICE

[76] Inventor: Jesse P. Fox, 80 Mineral Springs Mtn., Valdese, N.C. 28690

[21] Appl. No.: 151,015

[22] Filed: Feb. 1, 1988

[51] Int. Cl.[4] ..... B25B 1/06

[52] U.S. Cl. ..... 269/234; 269/277

[58] Field of Search ..... 269/271, 277, 268, 229, 269/234, 134, 137, 138, 136

[56] References Cited

U.S. PATENT DOCUMENTS

| | | | |
|---|---|---|---|
| 1,335,247 | 3/1920 | Lask . | |
| 1,958,705 | 5/1934 | Klein . | |
| 2,625,861 | 1/1953 | Swanson . | |
| 2,893,275 | 7/1959 | Lindemann . | |
| 3,184,228 | 5/1965 | Chenette et al. | 269/271 |
| 3,357,464 | 12/1967 | Vroman . | |
| 4,027,867 | 6/1977 | Pollington . | |
| 4,114,868 | 9/1978 | Smith | 269/136 |
| 4,223,879 | 9/1980 | Wolfe et al. | 269/136 |
| 4,588,178 | 5/1986 | Harrison . | |

FOREIGN PATENT DOCUMENTS

| | | | |
|---|---|---|---|
| 1179879 | 10/1964 | Fed. Rep. of Germany | 269/111 |
| 990489 | 1/1983 | U.S.S.R. | 269/234 |

*Primary Examiner*—Robert C. Watson

*Attorney, Agent, or Firm*—Shefte, Pinckney & Sawyer

[57] ABSTRACT

The present invention provides an accessory device for use between the jaws of a conventional milling machine or the like, and the accessory device includes two cooperating components. The first component includes a workpiece engaging surface and a sliding surface arranged in angular reaction thereto, and the second component also includes a sliding surface arranged in sliding abutment with the sliding surface of the first component, and a work engaging surface disposed in spaced parallel relation to the work engaging surface of the first component, whereby when the second component slides with respect to the first component, the work engaging surfaces can be moved together to hold a workpiece at a desired angle with respect to the cutting or grinding tool of the machine.

4 Claims, 3 Drawing Sheets

ACCESSORY WORK HOLDING ELEMENT FOR USE WITH A VICE

BACKGROUND OF THE INVENTION

This invention relates generally to an accessory element for holding a workpiece between the movable jaws of a vice used in machine shop equipment, such as machines for milling, boring, grinding and cutting the workpiece.

Typical machine shop equipment of the foregoing type, as for example, a milling machine, includes a turret in which a plurality of cutting tools and the like are mounted, the turret being turned to bring a selected one of the tools to bear on the workpiece which is to be machined. The workpiece to be machined is securely held in place between the jaws of a vice, which, in turn, is held in place on the bed of the milling machine beneath the cutting tool, and the bed is moved with respect to the cutting tool, generally back and forth in a horizontal plane while the tool is rotated about a vertical axis so that the workpiece can be brought into contact with the tool as may be appropriate for the particular machining operation being carried out.

Conventional vices used for holding the workpiece include a pair of jaws that are movable in a horizontal direction toward and away from one another, the jaws having opposed, vertical work engaging surfaces so that during such horizontal movement of the jaws toward one another a workpiece can be grasped and firmly held between the jaws. While this type of vice is satisfactory for many cutting operations, it offers only limited flexibility for positioning the workpiece with respect to the cutting or grinding tool and therefore some desired cutting operations cannot be practically carried out. For example, where it is desired to form a beveled edge at one end of a flat piece of metal, this generally cannot be done with a typical milling machine of the aforesaid type because the flat workpiece can only be supported in a vertical disposition between the vertical work engaging surfaces of the vice jaws, and therefore the cutting tool cannot be brought to bear against the end of the workpiece at the necessary angle to form the desired beveled edge.

To overcome this limitation, vices have been constructed with conventional spaced, parallel jaws that move toward and away from one another, and these jaws are also mounted on an arcuately-shaped support that permits selected arcuate movement of the entire vice so that the parallel work engaging surfaces of the jaws, and the workpiece held therebetween, can be disposed at selected angles with respect to the cutting tool. While this type of vice construction permits a much wider range of cutting operation, including the forming of a beveled edge as discussed above, it will be appreciated that the costs of providing a vice having the capability of compound jaw movement can be considerable, particularly when the vice must be large enough to support relatively heavy workpieces and when the arcuate support for the vice must be constructed at close tolerances to provide a relatively exact angle of support for the workpiece. Additionally, vices having this compound movement of the jaws may not be available for all types of milling machines.

By virtue of the present invention, a simple, inexpensive accessory is provided for use with virtually any type of shop machines having a vice for holding the workpiece, whereby the workpiece can be held at a desired angle with respect to the tool of the machine.

SUMMARY OF THE INVENTION

Briefly summarized, the accessory element of the present invention is preferably of two-piece construction for placement between the vertical work engaging surfaces of the jaws of a vice. The first component includes a base surface for resting on the support surface of the vice, and a first jaw engaging surface for engagement with one of the vertical surfaces of one of the vice jaws. This first component also includes a first work engaging surface that lies in a plane forming an acute angle with the vertical plane of the first jaw engaging surface, and a first sliding surface lying in a plane forming an angle with the plane of the first work engaging surface.

The second component of the accessory element has a second jaw engaging surface for engagement by the other of the vice jaws, and has a second work engaging surface extending generally parallel to the first work engaging surface for supporting a workpiece therebetween. The second component also includes a second sliding surface abutting said first sliding surface and disposed in sliding relationship thereto so that the first and second work engaging surfaces will be moved toward and away from one another as the second component is slidingly moved with respect to the first component as the jaws of the vice are moved toward and away from one another.

Thus, a workpiece may be located between the first and second work engaging surfaces and held securely in place thereat by movement of the vice jaws toward one another, and since the first and second work engaging surfaces are in parallel relation to each other and in angular relationship to the vertical, the workpiece is held at the same angular relationship to the vertical axis of the cutting tool located above the vice, thereby permitting the tool to make cuts at desired angles with respect to the surface of the workpiece.

In one embodiment of the present invention, the work engaging surfaces of the two components extend from the top, horizontal surface of the accessory element so that the workpiece held therebetween extends generally upwardly from the accessory element at a predetermined angle with respect to the horizontal top surface of the accessory element.

In another embodiment, the two work engaging surfaces extend inwardly from a vertical side face of the first component so that the workpiece held therebetween extends generally outwardly from the accessory element at a predetermined angle with respect to the vertical side face of the accessory element.

DESCRIPTION OF THE PREFERRED EMBODIMENTS

Figure 1:
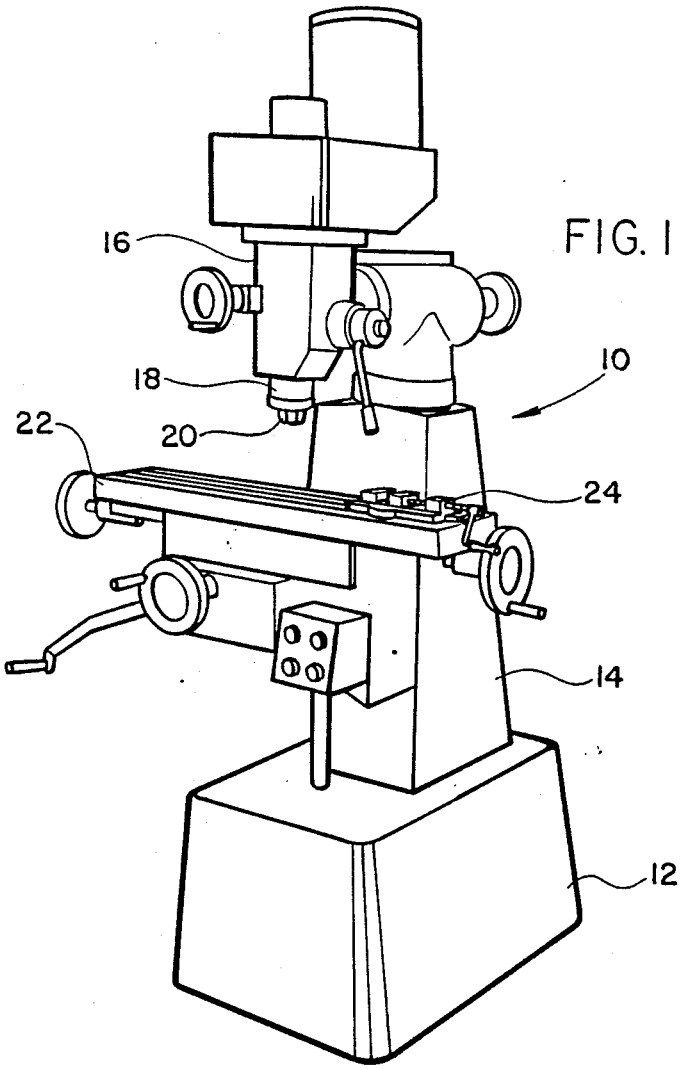
FIG. 1 illustrates a conventional milling machine with which the accessory element of the present invention can be readily used.

Looking now in greater detail at the accompanying drawings, FIG. 1 shows a typical and conventional ram-type turret milling machine 10 with which the present invention is usable, such as, for example, a Model 100-5700 turret milling machine manufactured by Enco Manufacturing Co. Norcross, Ga. The details of the milling machine 10 form no part of the present invention, and since the general construction and operation of conventional milling machines are well known in the art, only a brief description of the milling machine 10 and its operation are necessary for understanding the present invention.

The milling machine 10 includes a base 12 and a stanchion 14 extending upwardly therefrom to support the working or cutting head 16 of the machine, the head 16 including a turret 18 that swivels 360° so that different cutting tools 20 held by the head can be brought to bear on a workpiece to be machined. The stanchion 14 also supports a bed 22 located beneath the head 16, the bed 22 being movable in several different directions to permit a workpiece mounted on the bed 22 to be moved with respect to a generally stationary cutting tool 20 on the head 16 in performing various types of machining operations, all in a manner well known in the art.

Figure 1A:
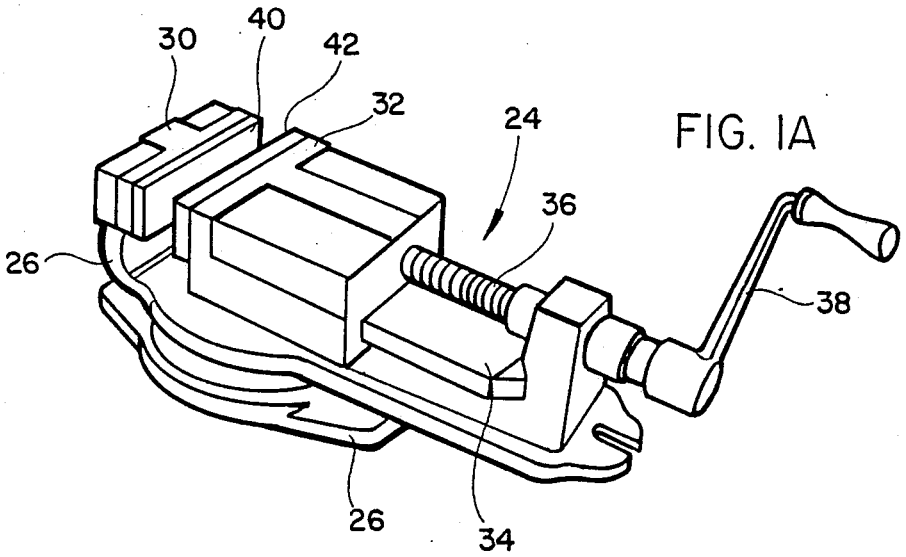
FIG. 1A illustrates in greater detail a typical vice used with the milling machine shown in FIG. 1.

Various sizes and shapes of workpieces to be machined are held in place on the bed 22 by a conventional vice 24, such as a Model 425-7061 manufactured by Enco Manufacturing Co. which is shown in greater detail in FIG. 1A. The vice 24 includes a two-piece swivel base comprised of a first swivel element that is fixedly mounted on the bed 22 of the milling machine 10, and a movable swivel element 28 on which two jaws 30 and 32 of the vice are mounted. The outermost jaw 30 is stationary, and the innermost jaw 32 rides on a track element 34 and is moved toward and away from the stationary outer jaw by a threaded screw element 36 having a handle 38 for turning the screw element 36 to move the inner jaw 32 in the aforesaid directions. It will be noted that the work engaging faces 40 and 42 of the jaws 30 and 32, respectively, extend in vertical planes and are disposed in spaced parallel relationship so that any workpiece placed therebetween will be held by the work engaging faces 40,42 of the jaws 30,32. Accordingly, it will be appreciated that workpieces held between the vertical work engaging faces 40,42 will suffer the limitations of positioning the workpiece at angles relative to the tools 20 of the milling machine 10 as discussed in greater detail above.

Figure 2:
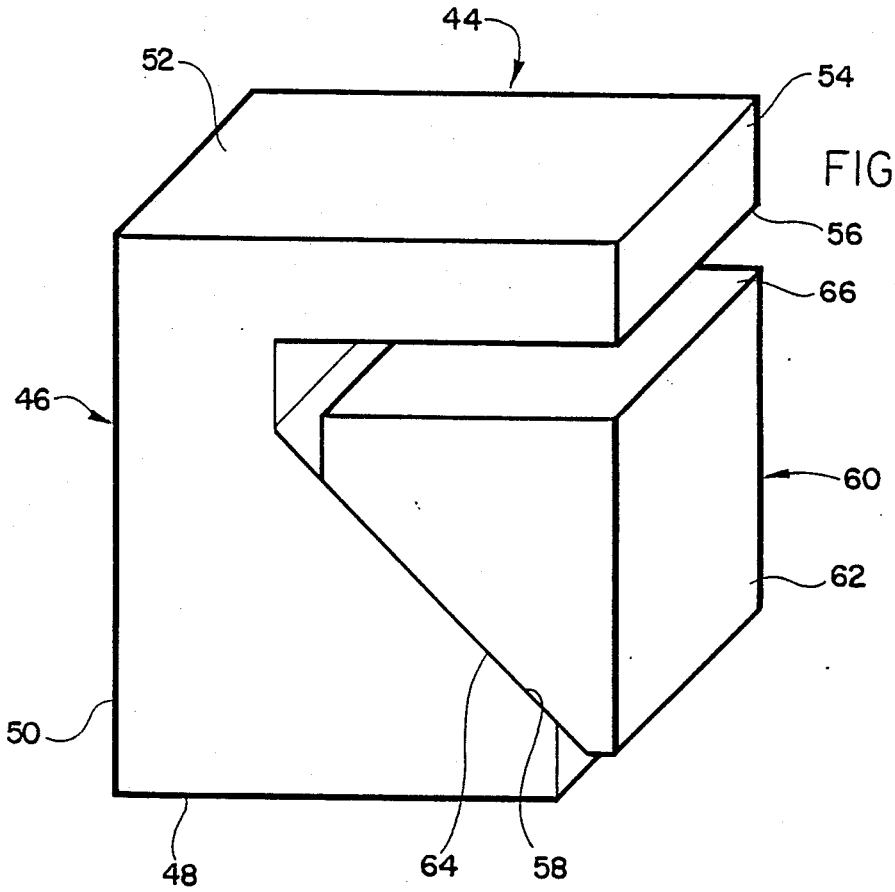
FIG. 2 is a perspective view illustrating one embodiment of the accessory element of the present invention.
Figure 3:
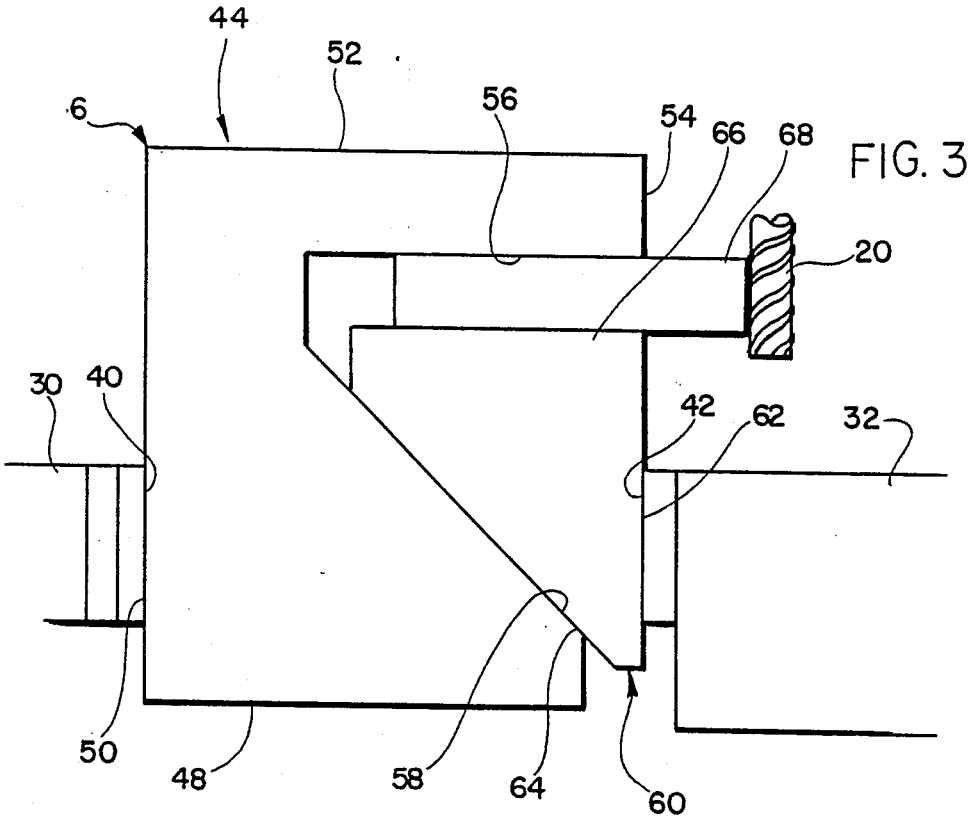
FIG. 3 is a side elevational view illustrating the accessory element of FIG. 3 located between the jaws of a vice.

One embodiment of the accessory device 44 of the present invention is shown in FIG. 2, and FIG. 3 illustrates the accessory device 44 located between the jaws 30,32 of the vice 24. As best seen in FIG. 2, the accessory device 44 includes a first component 46 that is generally a six-sided cube having a flat horizontal base surface 48 for resting on the support surface of the vice 24 or for being held slightly above the surface of the vice 24 by the vice jaws 30,32 if desired. Extending upwardly from the base surface 48 is a side surface 50 which is engaged by one of the jaws 30 when the accessory device 44 is in place in the vice 24 (see FIG. 3), and a top surface 52 extends in parallel relation to the base surface 48. An opposite side surface 54 is cut away to form a horizontally extending first flat work engaging surface 56 and a first flat sliding surface 58 which lies in a plane intersecting the plane of the work engaging surface 56 at a predetermined or desired angle as shown in FIGS. 2 and 3.

The accessory device 44 also includes a second component 60 that includes a vertically extending second jaw engaging surface 62 disposed generally parallel to the first jaw engaging surface 50 and arranged for engagement by the second or innermost jaw 32 of the vice 24 as shown in FIG. 3. The second component 60 includes a second flat sliding surface 64 that extends in angular relation to the second jaw engaging surface 62 and is disposed for sliding abutment on the first sliding surface 58 of the first component 46, thereby permitting relative movement between the first and second components 46,60 as the second component 60 slides up and down the first sliding surface 58. The second component 60 also includes a second flat work engaging surface 64 that is disposed in parallel relationship to the first work engaging surface 56 of the first component 46, the plane of the second work engaging surface 66 intersecting the plane of the second sliding surface 64 at an acute angle, whereby during the aforesaid sliding movement of the second component 60, the first and second work engaging surfaces 50,66 can be moved toward one another to grasp a workpiece 68 therebetween and hold the workpiece 68 at a predetermined angle with respect to the milling machine cutting tool 20 during a milling operation, as shown in FIG. 3. In the particular embodiment of the present invention shown in FIGS. 2 and 3, the first and second flat work engaging surfaces 56,66 extend in parallel horizontal planes so that the workpiece 68 is held in a horizontal position,or a position that is perpendicular to the plane of the side surfaces of the accessory device 44. This disposition of the workpiece 68 permits the outwardly extending edge thereof to be engaged directly by the cutting side faces of the tool 20 as generally illustrated in FIG. 3, whereby desired portions of the side edge of the workpiece 68 can be readily cut away. It will be apparent that a similar cutting operation by the cutting tool 20 would be difficult, if not impossible, using a conventional vice without the accessory device 44 of the present invention because the flat faces of the workpiece 68 would have to be held between the work engaging faces 40,42 of the vice 24 so that the outer edge of the workpiece 68 could only be presented to the bottom face of the cutting tool 20, rather than to the cutting side edges thereof. Also, while the specific embodiment of the accessory device 44 of the present invention as illustrated in FIGS. 2 and 3 show the first and second work engaging surfaces 56,66 to be disposed in horizontal planes, it will be understood that these work engaging surfaces could be cut at different angles with respect to the vertical side faces 54,62 if desired, and, indeed, the present invention contemplates that a well-equipped shop would be provided with a series of accessory devices 44 each of which is provided with a different angular relationship for the parallel first and second work engaging surfaces 56,66 so that any number of varied cutting operations could be performed by the milling machine 10.

Figure 4:
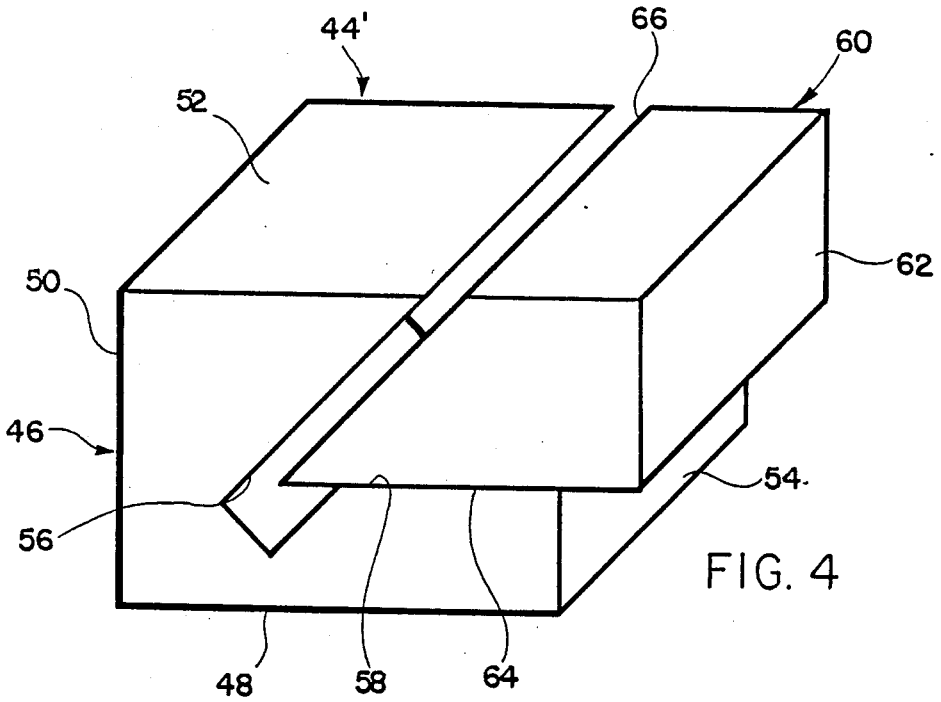
FIG. 4 is a perspective view illustrating another embodiment of the accessory element of the present invention.
Figure 5:
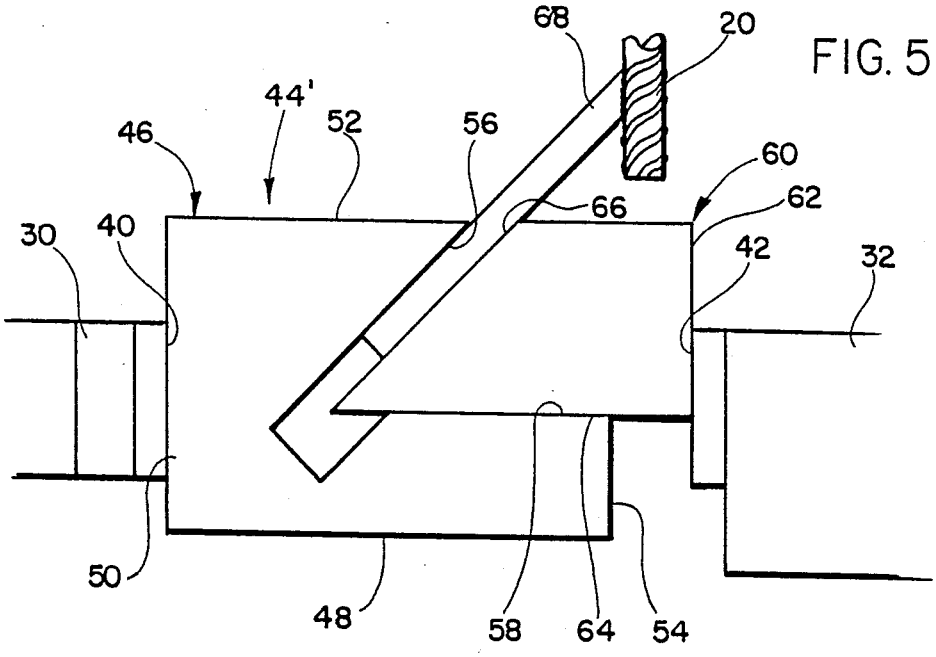
FIG. 5 is a side elevational view illustrating the accessory element of FIG. 5 located between the jaws of a vice.

Another embodiment of the present invention is illustrated in FIG. 4 as accessory element 44', and in FIG. 5 the accessory element 44' is shown positioned between the jaws 30,32 in the same manner as that described above in connection with FIG. 3. Since the number and description of the various surfaces of the accessory element 44' are essentially similar to the corresponding surfaces of the accessory element 44 described above, the same reference numerals have been used in FIGS. 4 and 5 to identify corresponding surfaces described above in connection with FIGS. 2 and 3. However, it is to be noted that in accessory element 44', the first work engaging surface 56 of the first component 46 extends inwardly from the top surface 52 of the first component 46 in a plane disposed at an acute angle with the plane of the top surface 52, and the first sliding surface 58 is cut inwardly from the side surface 54 in a horizontal plane so that it lies in the plane disposed at an acute angle with respect to the plane of the first work engaging surface 56. Similarly, the second work engaging surface 66 of the second 60 lies in a plane parallel to the plane of the first work engaging surface 56, and the second sliding surface 64 is disposed in a horizontal plane for sliding abutment with the first sliding surface 58. Thus, as shown in FIG. 5, the first and second work engaging surfaces 56,66 are disposed at an acute angle with respect to the top surface 52 of the first component 46 so that a workpiece 68 can be placed therebetween to extend upwardly from the accessory device 44' as shown in FIG. 5. At this disposition, it will be noted that the tool 20 can be brought to bear against the end face of the workpiece 68 at a predetermined desired angle to form a bevel at the outer edge of the workpiece 68. For example, if the first and second work engaging surfaces 56,66 are disposed at an angle of 45° with respect to the top surface 52, the bevel angle that can be cut at the outer of the workpice 68 will also be 45° . As discussed above, the angle of the work engaging surfaces 56,66 can be any desired angle, and it is anticipated that a number of different accessory elements 44' with different angular relationships will be provided so that a variety of cutting operations can be carried out.

Thus, the accessory device of the present invention is quite simple and inexpensive in construction, and it can be quickly and easily disposed between the jaws of a conventional vice to provide a significant amount of flexibility in terms of positioning workpieces at a number of different positions and angular relationships so that tools of the milling machine can be utilized in a number of different cutting and grinding operations not heretofore possible with conventional vice constructions.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the presnet invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. An accessory element for use between the movable jaws of milling machine vices and the like to hold a workpiece at a predetermined position with respect to the cutting tool of the milling machine, such accessory element comprising:

(a) a first component having a base surface, a top surface disposed in generally parallel relation to said base surface, and a first jaw engaging surface extending upwardly from said base surface for engagement by one of said jaws of said vice, said first component also having a first work engaging surface lying in a plane forming an angle with the plane of said first jaw engaging surface and extending inwardly from said top surface at an acute angle with respect thereto, and a first sliding surface lying in a plane forming an angle with said plane of said work engaging surface; and (b) a second component having a second jaw engaging surface for engagement by the other of said jaws of said vice, a second work engaging surface extending generally parallel to said first work engaging surface for supporting a workpiece therebetween whereby said workpiece can extend outwardly from said top surface of said first component, and a second sliding surface abutting said first sliding surface in sliding relationship thereto and arranged to cause said first and second work engaging surfaces to move toward and away from one another during sliding movement of said second sliding surface along said first sliding surface as said jaws of said vice move toward and away from one another.

2. An accessory element for use between the movable jaws of milling machine vices and the like to hold a workpiece at a predetermined position with respect to the cutting tool of the milling machine, said accessory element comprising:

(a) a first component having six surfaces formed generally as a cube, including:

(i) a flat horizontal base surface for resting on the support surface of said vice;

(ii) a first jaw engaging surface extending vertically in perpendicular relation to said base surface for engagement by one of said movable jaws of said vice;

(iii) a top surface extending in parallel spaced relation to said base surface;

(iv) a first flat work engaging surface lying in a plane intersecting the plane of said top surface and extending downwardly therefrom at an acute angle with respect thereto;

(v) a side surface extending in spaced generally parallel relation to said jaw engaging surface; and (vi) a first flat sliding surface lying in a plane intersecting the plane of said side surface and extending inwardly therefrom at a first predetermined angle, the plane of said first sliding surface also intersecting the plane of said first work engaging surface at a second predetermined angle;

(b) a second component generally supported by said first component and arranged for relative movement with respect thereto, said second component including:

(i) a second jaw engaging surface extending vertically in spaced parallel relation to said first jaw engaging surface for engagement by the other of said movable jaws;

(ii) a second flat sliding surface extending in angular relation to said second jaw engaging surface and disposed in abutment with said first sliding surface and in sliding relation thereto to permit relative movement between said first and second components when said jaws of said vice are opened and closed; and (iii) a second flat work engaging surface disposed in parallel relation to said first work engaging surface, the plane of said second work engaging surface intersecting the plane of said second sliding surface at an acute angle with respect thereto whereby during said sliding movement of said second component in relation to said first component said first and second work engaging surfaces can be moved toward one another to grasp a workpiece located therebetween and hold said workpiece at a predetermined angle with respect to said milling machine cutting tool during milling operations.

3. An accessory element for use between the movable jaws of milling machine vices and the like to hold a workpiece at a predetermined position with respect to the cutting tool of the milling machine, such accessory element comprising:

(a) a first component having a base surface, a first jaw engaging surface extending upwardly therefrom for engagement by one of said jaws of said vice, and a side surface disposed in generally parallel relation to said first jaw engaging surface, said first component also having a first work engaging surface lying in a plane forming an angle with the plane of said first jaw engaging surface and extending inwardly from said side surface at an angle with respect thereto, and a first sliding surface lying in a plane forming an angle with said plane of said work engaging surface; and (b) a second component having a second jaw engaging surface for engagement by the other of said jaws of said vice, a second work engaging surface extending generally parallel to said first work engaging surface for supporting a workpiece therebetween whereby said workpiece can extend outwardly from said side surface of said first component, and a second sliding surface abutting said first sliding surface in sliding relationship thereto and arranged to cause said first and second work engaging surfaces to move toward and away from one another during sliding movement of said second sliding surface along said first sliding surface as said jaws of said vice move toward and away from another another.

4. An accessory element as defined in claim 3 and further characterized in that said side surface of said second component extends parallel to said second jaw engaging surface of said second component.

* * * * *

UNITED STATES PATENT AND TRADEMARK OFFICE

CERTIFICATE OF CORRECTION

PATENT NO. : 4,834,356

DATED : May 30, 1989

INVENTOR(S) : Jesse Paul Fox

It is certified that error appears in the above-identified patent and that said Letters Patent is hereby corrected as shown below:

Column 5, Line 16, after "second" add -- component --.

Column 5, Line 32, after "outer" add --edge--.

Column 5, Line 32, delete "workpice" and insert therefor -- workpiece --.

Column 5, Lines 54-55, delete "presnet" and insert therefor -- present --.

Column 8, Line 25, delete "another another" and insert therefor -- one another --.

Signed and Sealed this

Ninth Day of June, 1992

*Attest:*

DOUGLAS B. COMER

*Attesting Officer*

*Acting Commissioner of Patents and Trademarks*